US006776148B1

(12) United States Patent
Islas

(10) Patent No.: US 6,776,148 B1
(45) Date of Patent: Aug. 17, 2004

(54) BOWSTRING CAM ARRANGEMENT FOR COMPOUND BOW

(76) Inventor: John J. Islas, 8504 Sextant Dr., Baldwinsville, NY (US) 13027

( * ) Notice: Subject to any disclaimer, the term of this patent is extended or adjusted under 35 U.S.C. 154(b) by 0 days.

(21) Appl. No.: 10/683,224

(22) Filed: Oct. 10, 2003

(51) Int. Cl.[7] ..... F41B 5/10
(52) U.S. Cl. ..... 124/25.6
(58) Field of Search ..... 124/25.6, 900

(56) References Cited

U.S. PATENT DOCUMENTS

| | | | | | |
|---|---|---|---|---|---|
| 4,457,288 | A | * | 7/1984 | Ricord | 124/25.6 |
| 4,667,649 | A | * | 5/1987 | Humphrey | 124/25.6 |
| 4,683,865 | A | * | 8/1987 | Troncoso | 124/25.6 |
| 4,757,799 | A | * | 7/1988 | Bozek | 124/25.6 |
| 4,781,168 | A | * | 11/1988 | Lester | 124/25.6 |
| 5,388,564 | A | | 2/1995 | Islas | 124/25.6 |
| 6,067,974 | A | | 5/2000 | Islas | 124/25.6 |
| 6,082,346 | A | | 7/2000 | Andrews et al. | 124/25.6 |
| 6,098,607 | A | * | 8/2000 | Strother | 124/25.6 |
| 6,474,324 | B1 | | 11/2002 | Despart et al. | 124/25.6 |
| 6,575,153 | B2 | | 6/2003 | Lommasson et al. | 124/25.6 |

* cited by examiner

*Primary Examiner*—John A. Ricci
(74) *Attorney, Agent, or Firm*—Bernhard P. Molldrem, Jr.

(57) ABSTRACT

A compound archery bow has a riser with upper and lower power or spring limbs, and a synchronizing pulley system for ensuring equal flexing of the limbs. There are bowstring cam members rotationally supported at the outboard ends of the power limbs. An inboard power cam is mounted on a pylon on the riser, and an outer power cam is coaxially mounted with the bowstring cam member. Cam cables extend over the inboard and outboard power cams. The bowstring cam members are configured so as to increase in effective radius as the bow returns from a full draw position to brace height. The power cams can be configured as a quad cam system.

7 Claims, 4 Drawing Sheets

BOWSTRING CAM ARRANGEMENT FOR COMPOUND BOW

BACKGROUND OF THE INVENTION

This invention is directed to the field of archery, and more specifically to compound bows of the type employing cams and control cables to achieve a programmed draw weight, and the latter being variable with draw length. The invention is more particularly concerned with improvements to such compound bows which make the bows more compact and streamlined, and which permit the archer to select the bow's draw characteristic, and which increases the bow's shooting performance.

A bow of this general type is described in my earlier U.S. Pat. Nos. 5,388,564 and 6,067,974. Those patents are incorporated herein by reference. Archery bows with programming means incorporated into them to regulate draw weight are also described in U.S. Pat. Nos. 3,854,417; 3,923,035; 3,486,495; and 4,287,867. These bows have means to regulate their draw weight so that a maximum pull weight is attained at an intermediate draw position, and with the draw weight dropping to some fraction of full draw weight at the full draw position. It is also an objective of such bows to transfer as much of the energy stored in the bow to the arrow, so that the arrow will fly faster and farther for a given draw weight. These goals have been difficult to achieve.

A number of compound bows have included one or more bowstring cams supported at the outer end of the spring limb or power limb. Typically one eccentric cam is provided on one limb, and there is a circular wheel at the end of the other limb. In addition, the bowstring cams currently used all are configured so that the radius increases on draw, i.e., the distance from the axis of the cam to the point of contact with the bowstring, i.e., the tangent with the bowstring. Accordingly, the radius decreases when the cam rewinds the bowstring. With this system, the rate at which the bow string moves forward becomes smaller as the bowstring approaches the fully released, i.e., brace position. This means that the bowstring does not accelerate the arrow optimally, and at least some of the energy stored in the power limb is wasted. Bows that employ bowstring cams are discussed, e.g., in Andrews et al. U.S. Pat. No. 6,082,346 and Despart et al. U.S. Pat. No. 6,474,324. In an ideal compound bow, all the energy stored in the power limbs should be transferred to the arrow to maximize the flight of the arrow. Also, any energy that remains in the bow will cause bow noise. Previous proposals for compound bows involving bowstring cams have not configured the mechanical advantage of the cam relative to the bowstring to maximize the energy transfer to the arrow.

OBJECTS AND SUMMARY OF THE INVENTION

Accordingly, it is an object of this invention to provide an improved compound bow that avoids the drawbacks present in the bows of the prior art.

It is another object to provide a bow that has increased performance for a given draw weight, and is quieter than current bows.

It is a further object to provide a compound bow that can be programmed easily to change its draw characteristics.

It is still another object of this invention to improve behavior of the bowstring cams of the compound bow.

One aspect of this invention involves an improvement to compound bows of the type that include a riser having an upper end and a lower end, with upper and lower resilient power limbs, i.e., spring limbs, that have their inboard ends affixed to the upper and lower ends of the riser, and synchronizing means, e.g., a cam and cable arrangement, for ensuring equal flexing of the upper and lower power limbs upon draw and release of the bowstring. In the bow according to preferred embodiments of the invention, there are upper and lower bowstring cams each being rotatably held at its axis on an outboard end of the power limb, and there are associated upper and lower power cam arrangements, each having one or more inboard cams rotatably held at a rigid portion of the riser, one or more outboard power cams affixed onto the associated bowstring cam to rotate with it, and one or more flexible inextensible cam cables extending over the periphery of the associated inboard and outboard power cams. The power cam arrangement is configured so as to cooperated and thus to determine draw characteristics of the bow. In embodiments of this invention, the bowstring cams are provided with a cam profile with a lobe or apex oriented such that the radius, from the axis thereof to the tangent with the bowstring, diminishes as the bowstring is drawn and increases as the bowstring returns after release from a drawn position to the full brace position. This changes the mechanical advantage of the cams on the bowstring after the bowstring is release so as to accelerate the bowstring and arrow. In other words, the rotational energy of the bowstring cam is transferred more efficiently to the arrow.

In a preferred arrangement, the bowstring cams may be forged of a lightweight metal. The bowstring cams may rotate over an angle exceeding 90 degrees between fully drawn and fully returned positions. The offset ratio of the bowstring cam, i.e., the size of the base circle relative to the lobe of the cam, may be on the order of ⅔, and in one preferred embodiment about 0.633. The profile of the bowstring cam achieves an optimal acceleration of the bow string and arrow, so that more of the bow's energy is transferred as kinetic energy to the arrow. This also gives the bow a quieter action.

The above and many other objects, features, and advantages of this invention will present themselves to persons skilled in this art from the ensuing description of preferred embodiments of this invention, as described with reference to the accompanying Drawing.

DETAILED DESCRIPTION OF THE PREFERRED EMBODIMENT(S)

Figure 1:
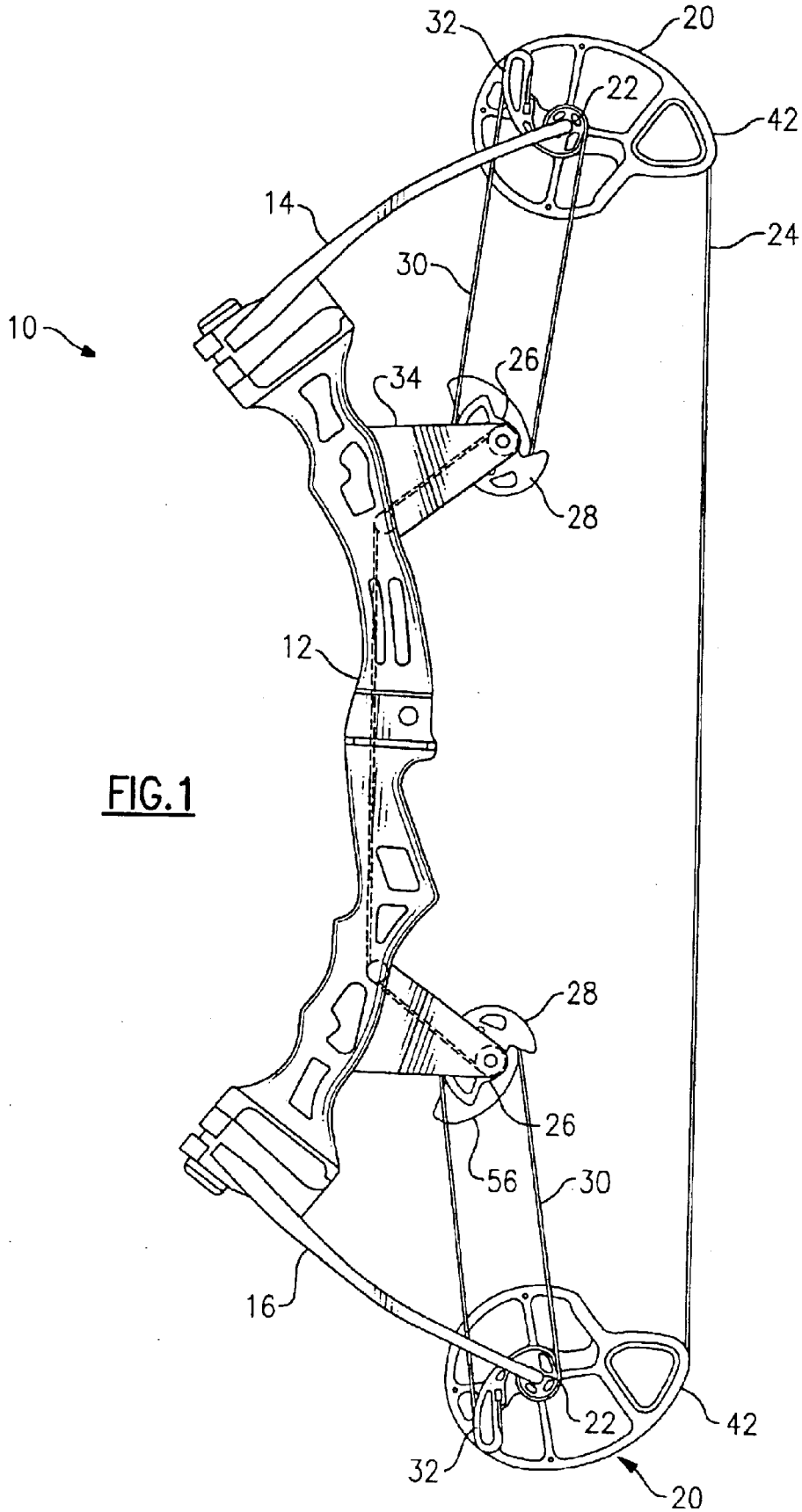
FIG. 1 is a side elevation of a compound bow according to one embodiment of this invention.

With reference to the Drawing, and initially to FIG. 1, a compound bow 10 according to the one embodiment of this invention has a riser 12 or handle portion at its center with upper and lower power limbs or spring limb portions 14, 16, with inboard ends that are affixed onto at the upper and lower ends of the riser. The bow is considered in its normal, upright shooting orientation, as is conventional. There are upper and lower bowstring cam members 20 that are pivotally or rotationally attached at respective pivot axes 22 to the outboard ends of the power limb members 14 and 16. A bow string 24 is attached to the bowstring cams 20 and rides in a peripheral groove or channel in each of these cams. Synchronizing pulleys 26 are pivotally mounted on the riser 12 near the ends. A continuous synchronizing cable is reeved to the synchronizing pulleys and passes over idler wheels and through a vertical cable passage in the riser 12. The action of the synchronizing pulley and cable system is well understood, and is employed for ensuring even flexing of the upper and lower limbs.

Figure 2:
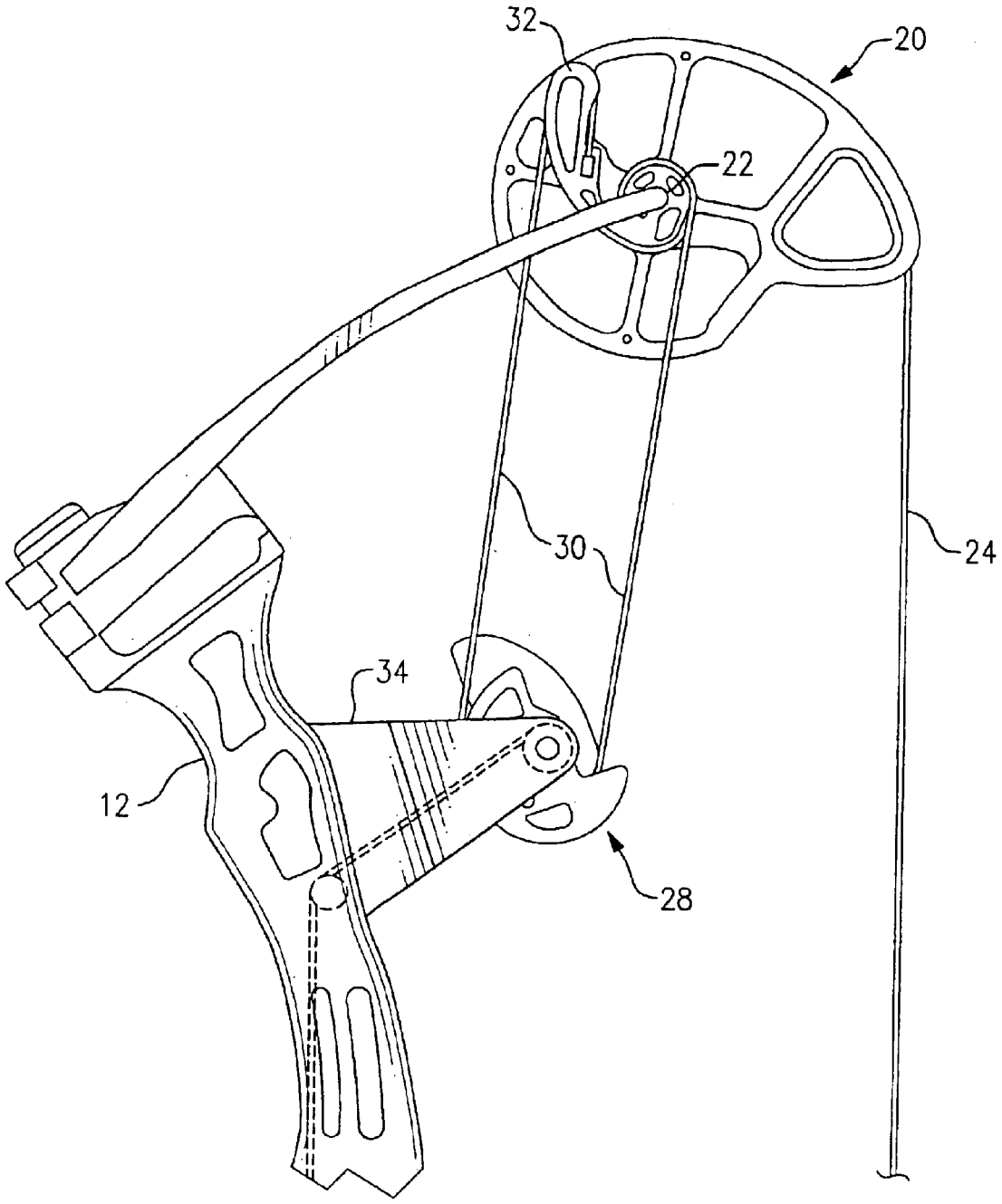
FIG. 2 is an enlarge elevation showing the upper part of the bow according to this embodiment.
Figure 3:
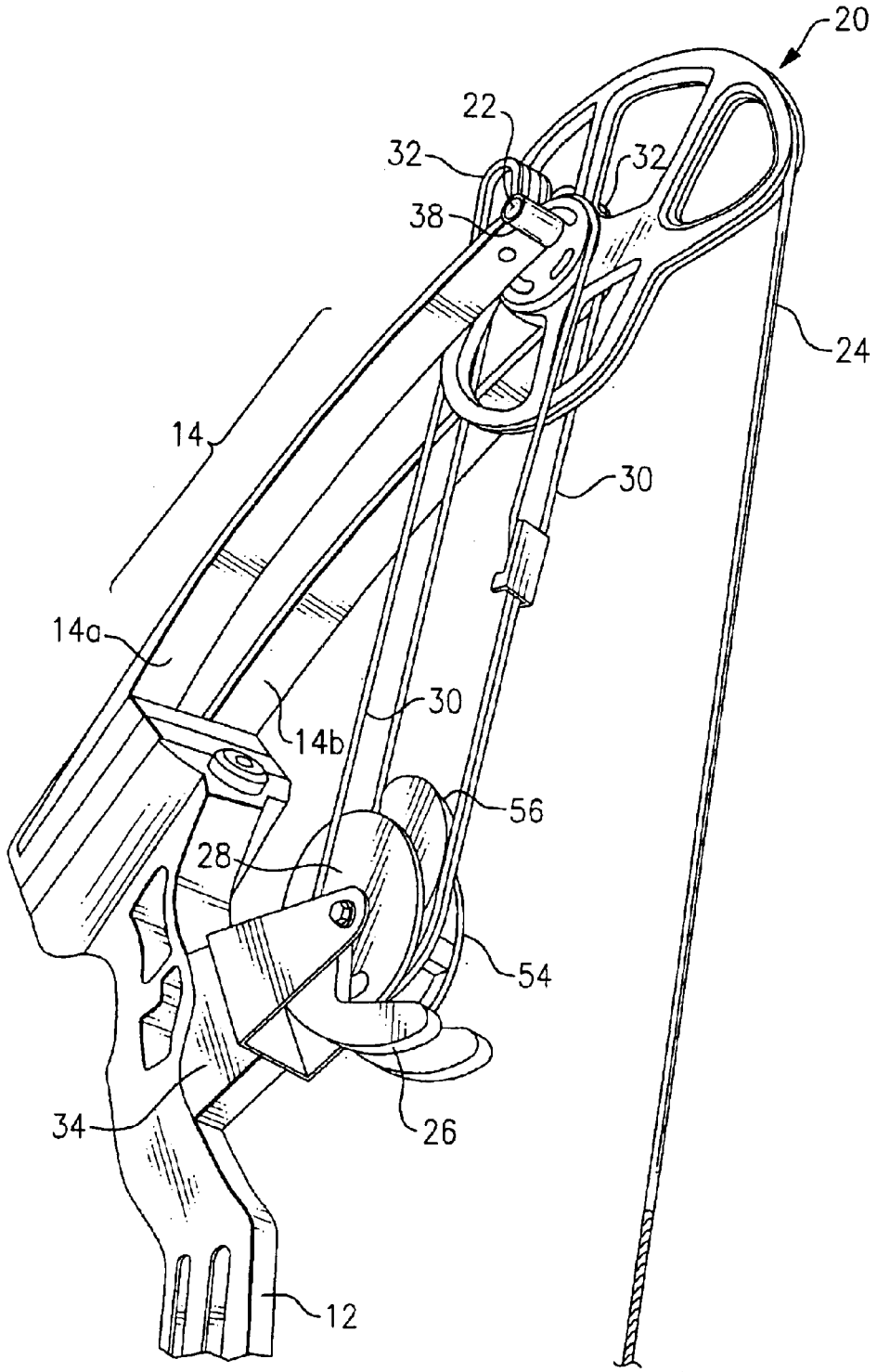
FIG. 3 is a perspective view of the upper limb of this embodiment.

With additional reference now to FIGS. 2 and 3, an inboard cam member 28 is affixed onto the synchronizing pulley 26, and carries a cam cable 30. The cam cable 30 is preferably reeved to the inboard cam 28. The cam cable 30 also rides in a cam groove of an outboard power cam member 32 that is mounted coaxially with the associated bowstring cam member 20. It should be noted that the inboard members 28 are mounted on upper and lower rigid pylons 34 that project proximally (toward the archer position), which improves the mechanical advantage. That is, the pylon positions the inboard cam member 32 so that the cam cables 30 pull the outboard cams at a relatively steep angle relative to the power limbs, and pull against a point that is fixed in relation to the bow riser, and not against the other bow limb.

Means are employed for preventing the limbs from becoming twisted when the string 24 is drawn, and this can be achieved by employing a quad cam action, as shown. Here, for each of the upper and lower limbs 14, 16, there are a pair of inboard power cam members 28 supported coaxially on the associated pylon 34, a pair of outboard cam members 32, mounted on either side of the associated bowstring cam member 20, and two sets of cam cables 30. The cables 30 are flexible, and inextensible. A quad cam arrangement has been described in my earlier U.S. Pat. No. 6,067,974. In this embodiment, the synchronizing wheel or pulley and synchronizing cable(s) are configured in a manner such as is discussed in that patent. As shown in FIG. 3, the spring limb or power limb 14 is formed of a pair of parallel spring components 14*a* and 14*b*, with the bowstring cam member 20 and the outboard cam members 32, 32 supported between the ends of the two components 14*a*, 14*b*. A journal member 36 is mounted at the outboard end of each component 14*a*, 14*b*, and supports the cam members 20 and 32.

Figure 4:
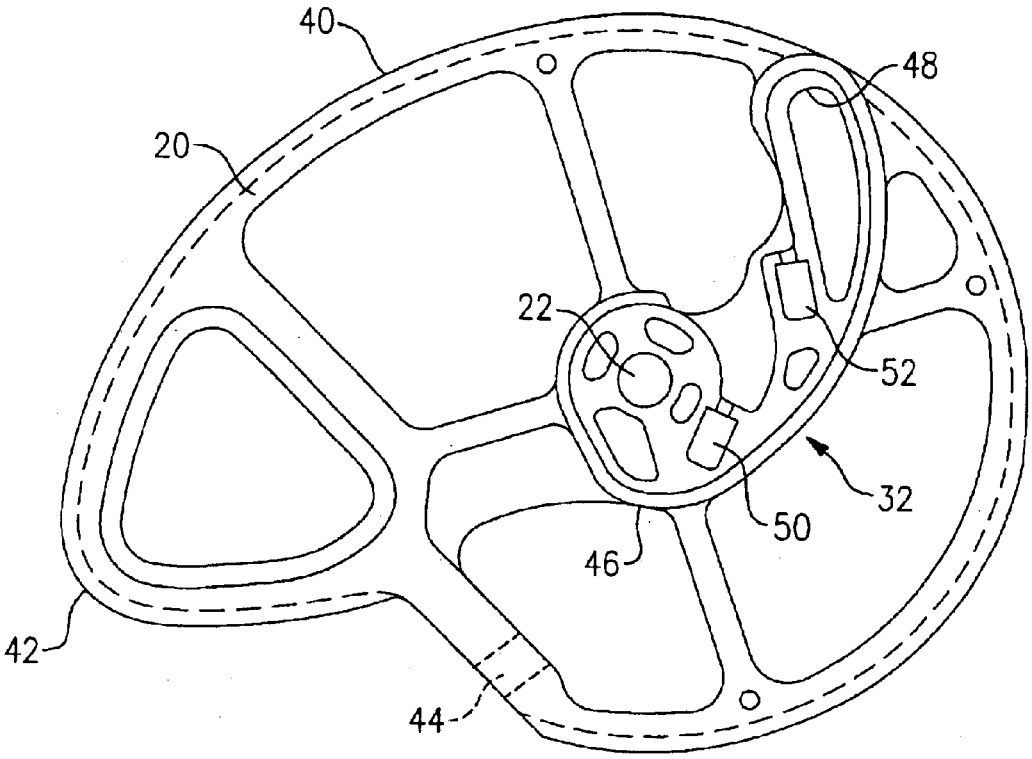
FIGS. 4 and 5 are view of the bowstring cam and the inboard power cam respectively of this embodiment.

FIG. 4 shows one side of the bowstring cam member 20, here, the upper cam member as shown in FIG. 2. The lower cam member would be a mirror image of this cam member. The cam member 20 has a peripheral groove 40 in which the bowstring 24 rides. The bow string passes over a protuberance or cam lobe portion 42 of the cam member 20, and follows the groove 40 around the periphery of the cam member to an anchor point 44. In this embodiment, the ratio of the radius of the main base circle of the cam member 20 from the axis 22 to the groove 40, to the radius from the axis to the groove at the apex of the lobe 42, is about 2:3, and more specifically 0.633 in this embodiment. The amount of cam offset selected may vary from one bow to another, or from one archer to another. The amount of cam rotation between full draw and full brace, i.e., rotary stroke, for the cam member 20 may exceed ninety degrees of arc, and can be about 135 degrees.

One of the outboard power cam members 32 is shown, with another that is a mirror image thereof being likewise positioned on the other side of the cam member 20. The cam member 32 has a peripheral groove 46 in which one or another of the cam cables 30 rides, and this groove follows from a smaller diameter circular portion out to a protuberance or lobe portion 48. There are anchor points 50 and 52 to which ends of the cam cables are anchored.

Figure 5:
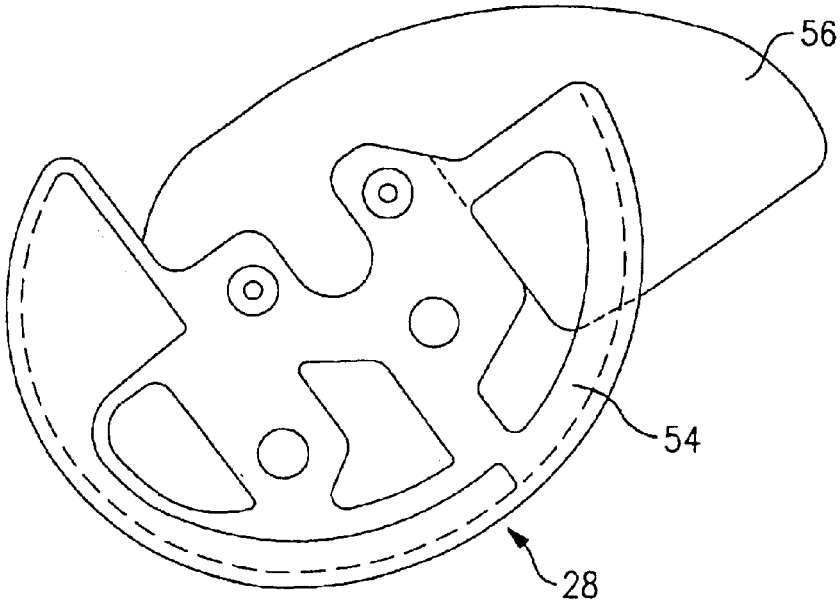

As shown in FIG. 5, the inner power cam member 28 has a main portion 54, and an insert portion 56, which may be interchanged with another insert portion of a different shape in order to bring about a desired draw characteristic for the bow. One section of the cam cable 30 passes over the periphery of the main portion 54 and another section of the cable passes over the insert portion 56. Also, the position of the insert portion may be shifted to make small adjustments to the draw of the bow.

The bowstring cam member 20 in this embodiment may be molded or forged, or made from extruded metal stock, and may have cutouts and spokes to make it light in weight. The cutouts serve to relieve some of the mass of the cam member, without any sacrifice of rigidity.

The cam member 20, or an equivalent cam wheel, positioned on the outboard end of the power limb 14 (or 16) increases its effective diameter from a full draw position (i.e., fully rotated out) to brace height (fully returned) when the archer releases the bow string. This acts to increase arrow speed by accelerating the bow string during take up. The rotational energy in the cam member 20 at the end of travel, coupled with the increase in radius at that point, causes a more efficient transfer of mechanical energy into the bowstring 24 and the arrow. This mechanism allows the bow to maintain bow string tension all the way from full draw to brace height. The bow maintains string tension as well as or better than other types of compound bows, and even those that have a cam action that is the reverse of the cam members of this invention. This mechanism works quite effectively on the quad cam system bow as illustrated, but the bowstring cam member 20 that embodies the principles of this invention can be used to advantage with other compound bow systems.

While the invention has been described and illustrated in respect to a few selected preferred embodiments, it should be appreciated that the invention is not limited only to those precise embodiments. Rather, many modifications and variations would present themselves to those of skill in the art without departing from the scope and spirit of this invention, as defined in the appended claims.

I claim:

1. A compound archery bow having upper and lower bowstring cams on which a bowstring is carried, in which the bow includes a riser having an upper end and a lower end, upper and lower resilient power limbs each having an inboard end affixed respectively to the upper and lower ends of the riser and an outboard end, synchronizing means for ensuring equal flexing of said upper and lower power limbs upon draw and release of said bowstring; said upper and lower bowstring cams each being rotatably held at an axis at an the outboard end of the respective one of said power limbs; and upper and lower power cam arrangements, each having one or more inboard cams rotatably held at a rigid portion of the riser, one or more outboard power cams affixed onto the associated bowstring cam to rotate therewith, and one or more flexible inextensible cam cables extending over the periphery of the associated inboard and outboard power cams, with the cam cables and the inboard and outboard power cams cooperating to determine draw characteristics of said bow; and wherein said bowstring cams are provided with a cam profile such that the radius from the axis thereof to a tangent with said bowstring, diminishes as the bowstring is drawn and increases as the bowstring returns after release from a drawn position.

2. The compound bow according to claim 1 wherein said power cam arrangements include upper and lower quad cam arrangements, with said inboard power cams including left and right cam plates mounted to rotate with said synchronizing means, and said outboard power cams including left and right cam plates mounted on opposite sides of the associated bowstring cam.

3. The compound bow according to claim 1 wherein inboard power cams each include a replaceable insert to permit selection of the draw characteristics of the bow.

4. The compound bow according to claim 1 wherein said inboard power cams are rotatably mounted on upper and lower pylons that project proximally of said riser.

5. The compound bow according to claim 1 wherein said upper and lower bowstring cams have a cam profile such that the ratio of the radius to a tangent with the bowstring when fully drawn to the radius of the tangent with the string when fully returned is substantially 2:3.

6. The compound bow according to claim 5 wherein said ratio is substantially 0.633.

7. The compound bow according to claim 1 wherein said bowstring cams have a rotary stroke exceeding 90 degrees between fully drawn and fully released positions.

* * * * *